US007370740B2

(12) United States Patent
Chang et al.

(10) Patent No.: US 7,370,740 B2
(45) Date of Patent: May 13, 2008

(54) RETRACTABLE LUGGAGE HANDLE WITH DAMPISH EXTENDING SPEED

(75) Inventors: Shih Yu Chang, Taipei (TW); Chung-Hsien Kuo, Pan-Chiao (TW)

(73) Assignee: Chaw Khong Technology Co., Ltd., Taipei County (TW)

( * ) Notice: Subject to any disclaimer, the term of this patent is extended or adjusted under 35 U.S.C. 154(b) by 714 days.

(21) Appl. No.: 10/796,975

(22) Filed: Mar. 11, 2004

(65) Prior Publication Data

US 2004/0178036 A1 Sep. 16, 2004

(30) Foreign Application Priority Data

Mar. 12, 2003 (CN) ..... 03 2 40533

(51) Int. Cl.
*A45C 13/26* (2006.01)

(52) U.S. Cl. ..... 190/115; 16/113.1

(58) Field of Classification Search ..... 190/115; 16/113.1

See application file for complete search history.

(56) References Cited

U.S. PATENT DOCUMENTS

| | | | | | |
|---|---|---|---|---|---|
| 5,499,702 | A * | 3/1996 | Wang | 190/115 |
| 5,522,615 | A * | 6/1996 | Kazmark et al. | 280/655 |
| 5,613,273 | A * | 3/1997 | Tsai | 16/113.1 |
| 5,692,266 | A * | 12/1997 | Tsai | 16/113.1 |
| 5,732,443 | A * | 3/1998 | Kazmark et al. | 16/113.1 |
| 5,803,214 | A * | 9/1998 | Wang | 190/115 |
| 5,884,362 | A * | 3/1999 | Tsai | 16/113.1 |
| 6,161,253 | A * | 12/2000 | Tu | 16/113.1 |
| 6,301,746 | B1 * | 10/2001 | Myers et al. | 16/113.1 |
| 6,934,997 | B2 * | 8/2005 | Lau | 16/114.1 |

* cited by examiner

*Primary Examiner*—Tri M. Mai
(74) *Attorney, Agent, or Firm*—Troxell Law Office, PLLC

(57) ABSTRACT

A retractable handle assembly for luggage case is disclosed. In a pulling operation, press a push button to unlock a locking device such that a damping device thereunder is free to damply extend upward a predetermined distance in a substantially stable speed for easing a pulling of the handle thereafter.

4 Claims, 5 Drawing Sheets

RETRACTABLE LUGGAGE HANDLE WITH DAMPISH EXTENDING SPEED

BACKGROUND OF THE INVENTION

1. Field of the Invention

The present invention relates to a retractable handle of luggage and more particularly to such a retractable handle having a damping device which is capable of damply extending upward a predetermined distance in a substantially stable speed when a push button is pressed for easing a pulling of the handle thereafter.

2. Description of Related Art

Wheeled luggage cases have developed rapidly over past several decades as more people travel either for business or leisure. Early luggage handle assemblies are exposed, thus detracting from its external appearance. In recent years, most handle assemblies are concealed in the luggage with only a top portion of the handle grip exposed. This can preserve the luggage's appearance. For facilitating user to pull the handle grip, a recessed bezel is typically provided on the top of the luggage. It inevitably much detracts from its external appearance. For solving this problem, a number of designs about automatically bouncing a handle out of luggage have been proposed in many prior patents. See, for example, U.S. Pat. No. 5,692,266, entitled "Concealable And Expandable Handle' and Taiwanese Patent Published No. 380,389 entitled "Fixing Assembly For Luggage Handle Spring" are two of them. The former discloses a spring for bouncing out the handle being formed in a bottom of support tube, while the latter discloses the spring for bouncing out the handle being formed in a lower portion of sliding tube. In operation, a user can press a push button on the handle grip to bounce out the handle. In one aspect it is convenient. However, the sudden bouncing of the handle grip having a bounce distance from about 20 cm to about 30 cm may cause danger. For example, the head and/or the eyes of a user may be hurt by the bounced handle grip when the head of the user is close to the handle grip in pressing the push button and sufficient care is not taken. This is not safe and is unsightly due to larger bounce distance from about 20 cm to about 30 cm. Moreover, length of the handle may be shortened if the spring is provided either in the bottom of support tube or in the lower portion of sliding tube. Thus, the need for improvement still exists.

SUMMARY OF THE INVENTION

It is an object of the present invention to provide a retractable luggage handle having a damping device which is capable of damply extending upward a predetermined distance in a substantially stable speed when a push button is pressed.

It is another object of the present invention to provide a retractable luggage handle having a damping device which is capable of damply extending upward a predetermined distance in a substantially stable speed for easing a pulling of the handle thereafter. Hence, operation of the handle of the present invention is much easy and safe as compared with the well known handle.

The above and other objects, features and advantages of the present invention will become apparent from the following detailed description taken with the accompanying drawings.

DETAILED DESCRIPTION OF THE PREFERRED EMBODIMENTS

Figure 1:
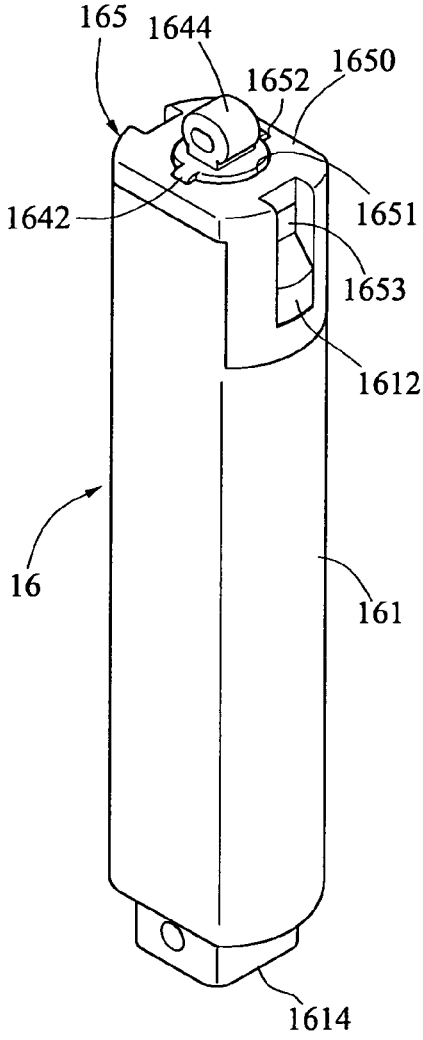
FIG. 1 is a perspective view of a first preferred embodiment of damping device mounted in a retractable luggage handle according to the invention.
Figure 2:
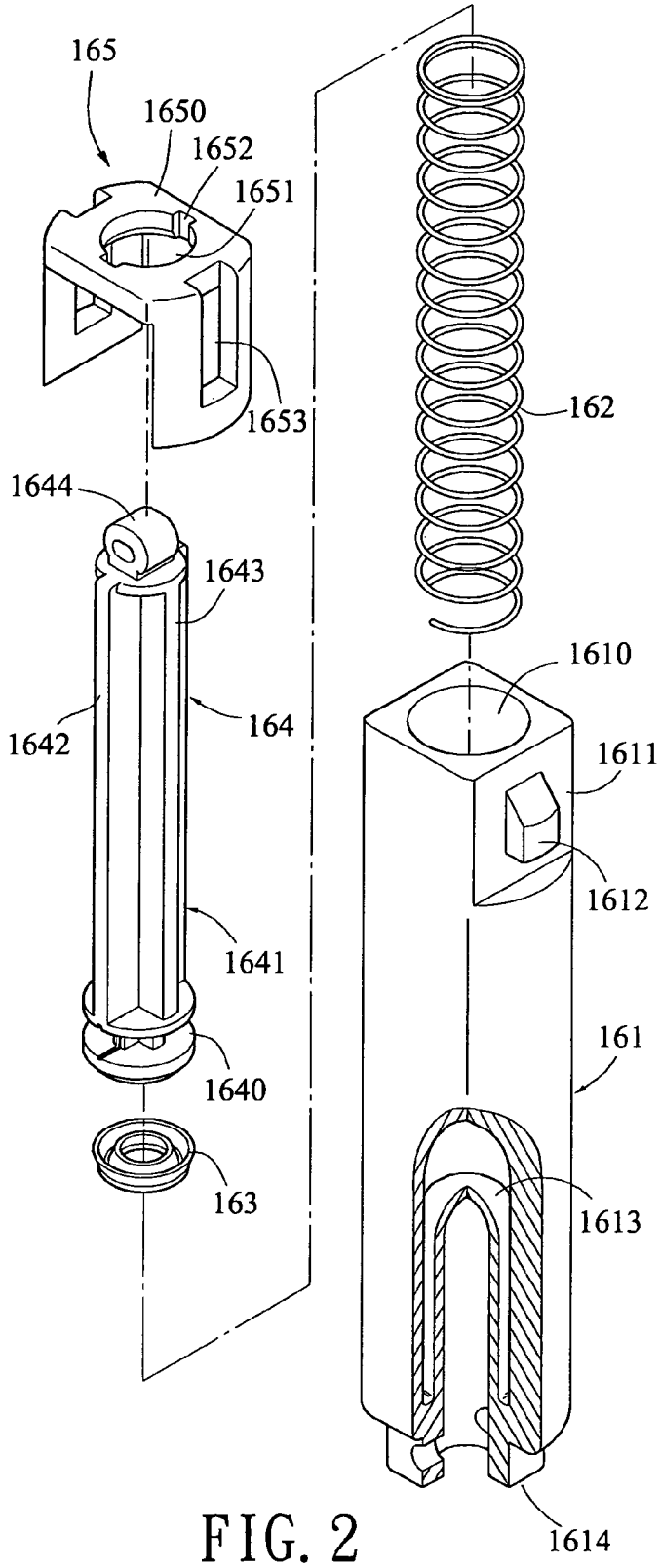
FIG. 2 is an exploded perspective view of the damping device of FIG. 1.
Figure 3:
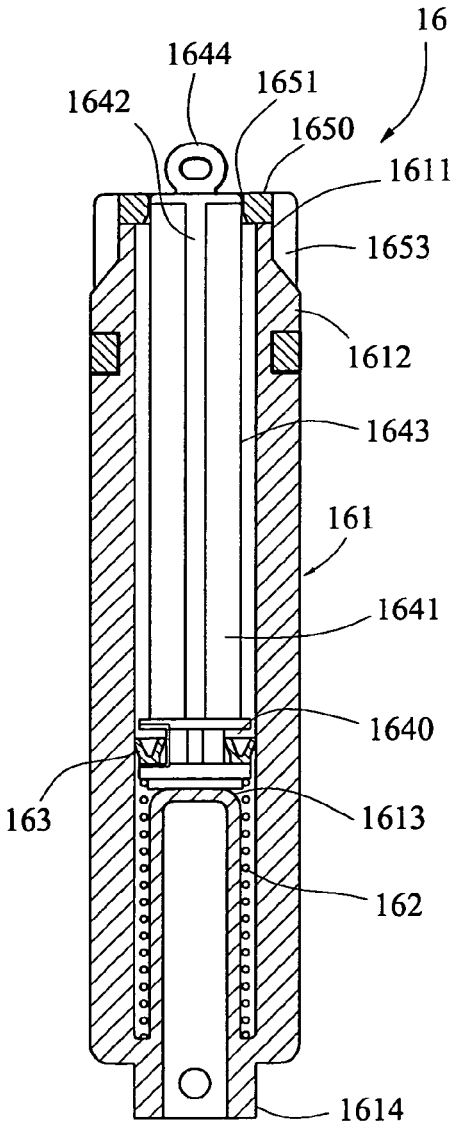
FIG. 3 is a cross-sectional view of the damping device in a nonoperating position in FIG. 1.
Figure 4:
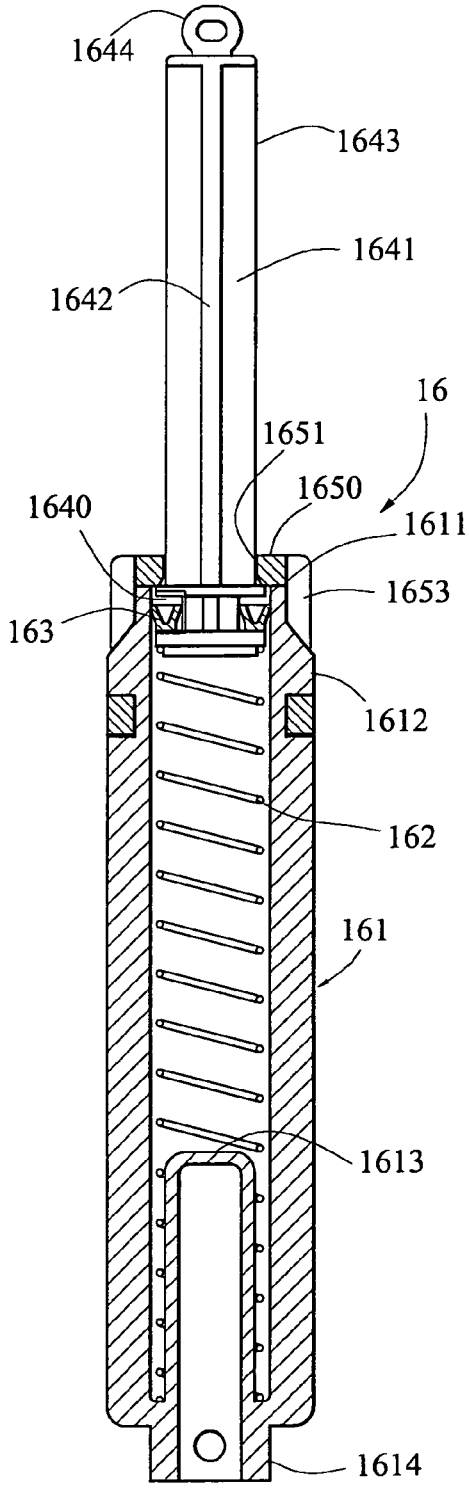
FIG. 4 is a view similar to FIG. 3 where the damping device is in an unlocked, extended position after pressing a push button.

Referring to FIGS. 1 to 8, there is shown a retractable handle assembly incorporating a first preferred embodiment of damping device 16 according to the invention. The handle assembly is mounted in a luggage case. In either side of the handle assembly, the handle comprises a support with a support tube 13 extended upwardly, the support tube 13 including an upper locking aperture 131 and a lower locking aperture 132, a sliding tube 12 slidably disposed in the support tube 13, the sliding tube 12 including an upper hole 121 and a lower hole 122, a handle grip 10 having an intermediate push button 18, one end of the handle grip 10 fastened at the upper hole 121, a locking device 20 provided in a lower portion of the sliding tube 12, a connecting rod 15 interconnected the push button 10 and the locking device 20 such that the connecting rod 15 can be manipulated by pressing the push button 10, and a damping device 16 provided in a lower portion of the support tube 13.

The locking device 20 comprises a locking mechanism 21 having an upper portion coupled to a lower end of the connecting rod 15, a lower portion fixedly coupled to a lower hole 122 of the sliding tube 12 by means of a pin 14, and a cavity 215 in the lower portion of the locking device 20; a spring 23 in the cavity 215; a locking block 24 anchored in the cavity 215; and a locking tab 240 projected from the locking block 24.

The damping device 16 comprises a hollow upright plunger 161, a second spring 162 anchored in the plunger 161, a piston rod 164 provided above the second spring 162, a sealing ring 163 biased between the piston rod 164 and the second spring 162, and a top cap 165 mounted on the plunger 161 for anchoring the piston rod 164 and the second spring 162 within the plunger 161 as detailed later. The plunger 161 comprises a bore 1610 open to the top, a coupling 1614 extended downward from an enclosed lower end, a post 1613 extended upward from the enclosed lower end inside the bore 1610 with the second spring 162 put thereon, two flats 1611 at both sides adjacent the top, and a projection 1612 on either flat 1611. The piston rod 164 comprises a lower neck 1640, an upright 1641 having a section of cross wherein one bar 1643 of the lateral section thereof is shorter than the other bar 1642 thereof, and a top pipe arm 1644 coupled to a bottom end of the locking device 20. The cap 165 comprises a frame 1650 in a shape of "n", a top hole 1651, two opposite dents 1652 on the edge of the hole 1651 with a top portion of the longer bar 1642 loosely fit in the dents 1652 such that the piston rod 164 is able to slide longitudinally along the dents 1652, and a longitudinal groove 1653 on either wing with the projection 1612 disposed therein by snapping the wings of the cap 165 downwardly onto the flats 1611 so as to fasten components such as the second spring 162, the sealing ring 163, and the piston rod 164 in the plunger 161.

Figure 5:
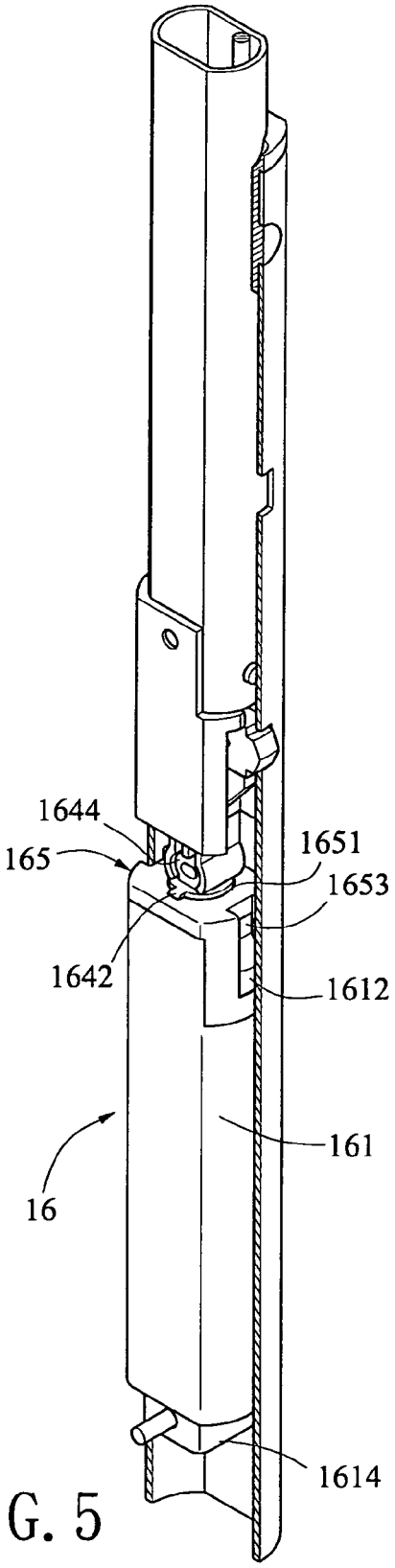
FIG. 5 is a broken-away perspective view of the pulling rod for illustrating the nonoperating position thereof.

The operation of the handle including the handle grip 10, the push button 18, the damping device 16, and the locking device 20 will now be described with reference to FIGS. 5 to 8. As shown in FIGS. 5 and 7, in a nonoperating position, the sliding tube 12 is substantially disposed in the support tube 13 with the length of the pulling rod reduced to a minimum. Also, the locking tab 240 is projected from the lower locking aperture 132 by expansion of the spring 23, and the piston rod 164 is fastened in the plunger 161 in a locked position of the handle.

Figure 6:
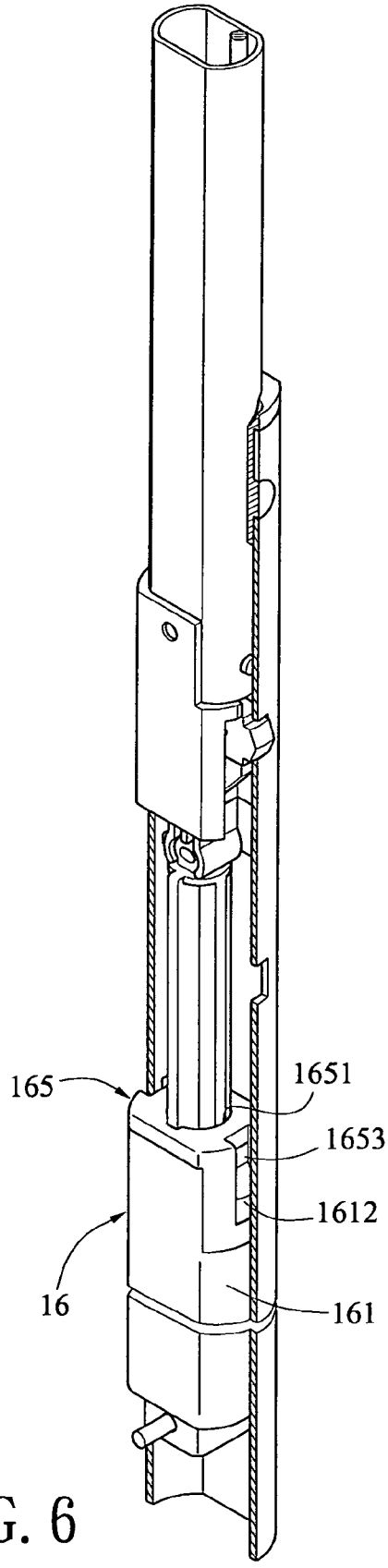
FIG. 6 is a view similar to FIG. 5 for illustrating the operating position of the pulling rod.
Figure 7:
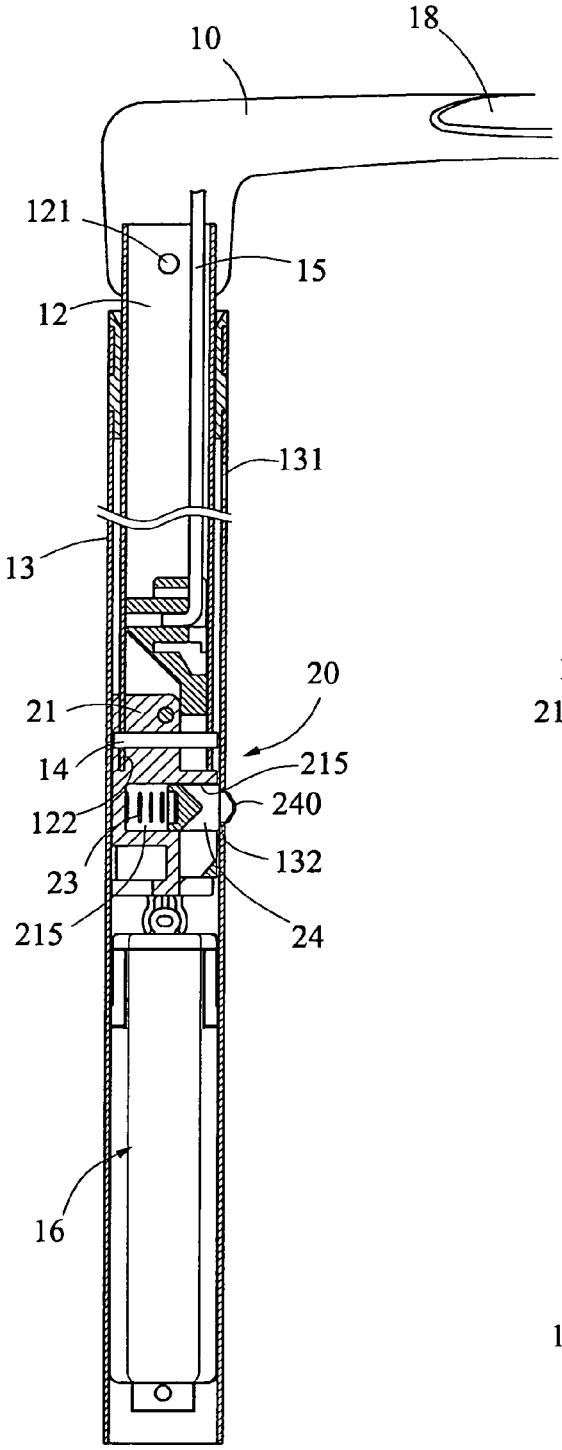
FIG. 7 is a cross-sectional view of the handle for illustrating the nonoperating position thereof.
Figure 8:
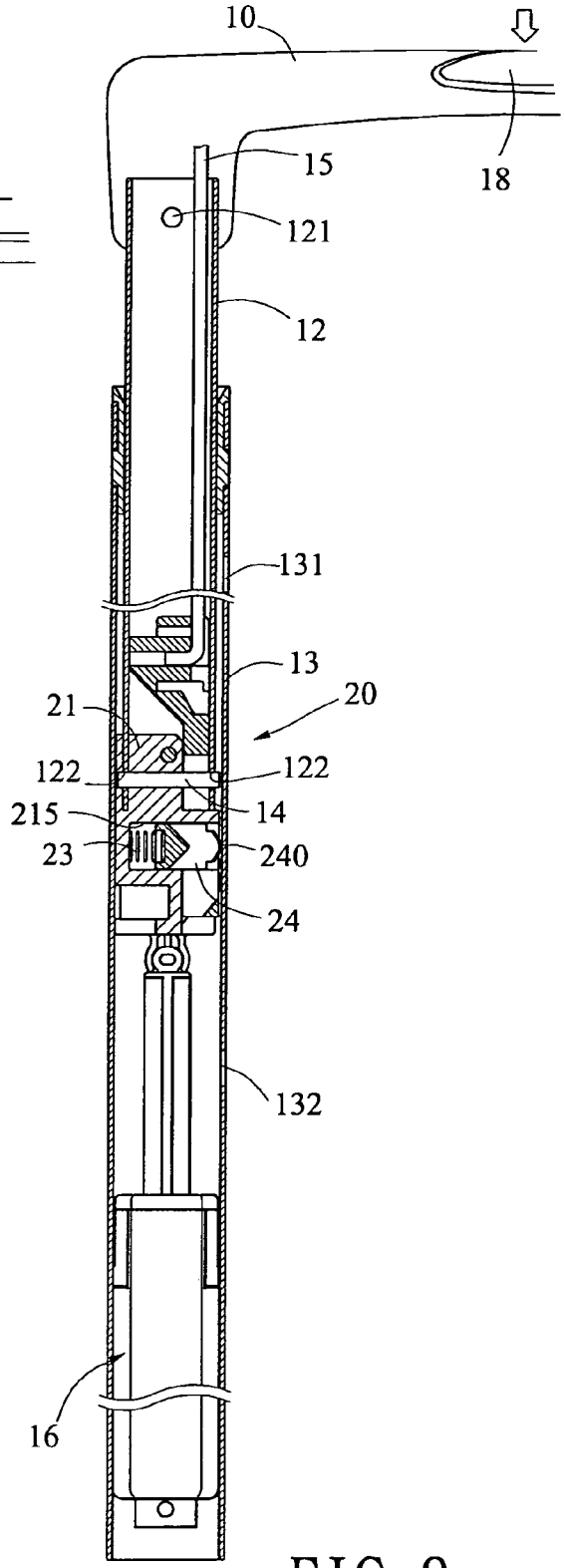
FIG. 8 is a view similar to FIG. 7 for illustrating the operating position of the handle.

As shown in FIGS. 6 and 8, for pulling the handle up, a user should first press the push button 18 to cause the connecting rod 15 to lower. As such, the spring 23 is compressed to clear the locking tab 240 from the lower locking aperture 132 to retract inside the support tube 13, as shows in FIG. 8. The force exerted on the second spring 162 is released suddenly. As a result, each of locking device 20 and the piston rod 164 damply moves upward in a substantially stable speed to cause the handle (i.e., the sliding tube 12 or the handle grip) to extend from the top of luggage a predetermined distance. At this position, a user can easily pull the handle rod up to its maximum by holding the handle grip. In view of the above, operation of the handle of the invention is much easy and safe as compared with the well known handle.

Figure 9:
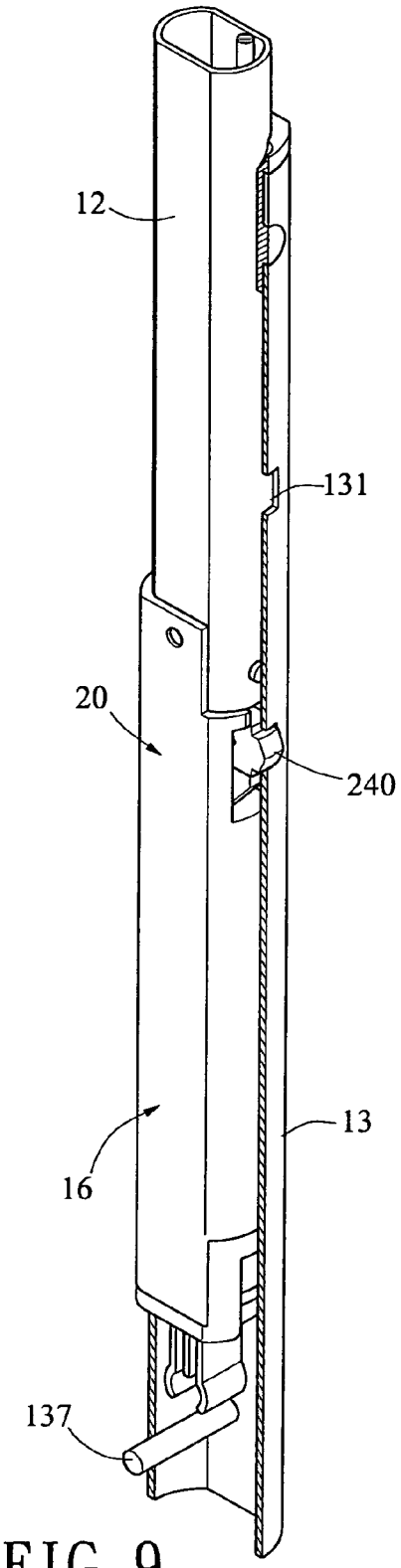
FIG. 9 is a broken-away perspective view of the pulling rod incorporating a second preferred embodiment of damping device according to the invention.
Figure 10:
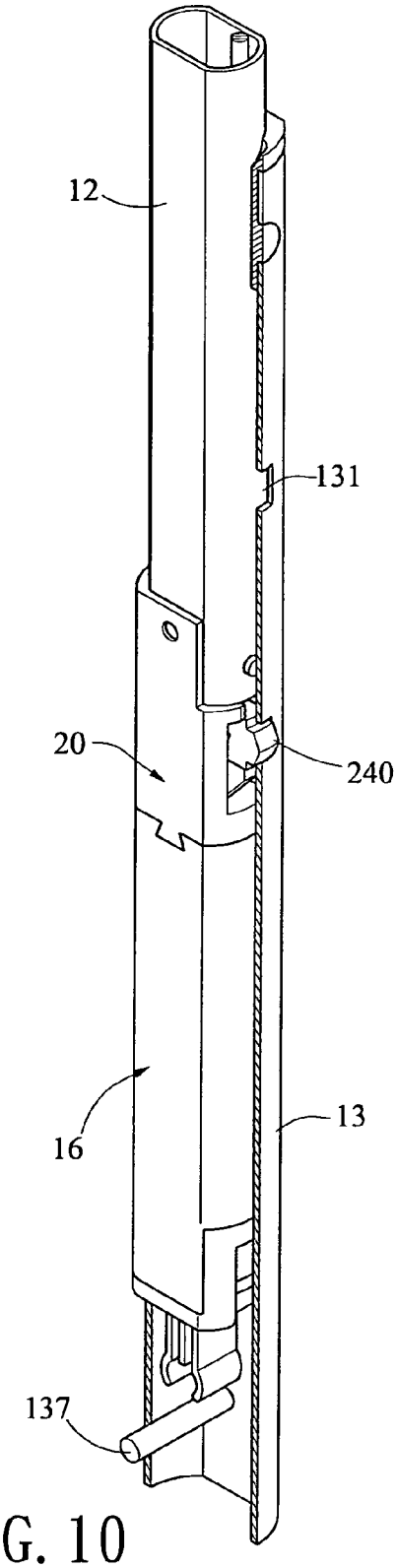
FIG. 10 is a broken-away perspective view of the pulling rod incorporating a third preferred embodiment of damping device according to the invention.

While the invention has been described by disposing the damping device 16 in the lower portion of the support tube 13, it is appreciated by those skilled in the art that the damping device 16 can be also provided under the sliding tube 12 a predetermined distance with an integral locking device 20 formed therebetween in a second preferred embodiment of the invention (see FIG. 9). Alternatively, the damping device 16 can be also provided in an appropriate space position between a bottom of the sliding tube 12 and a bottom of the support tube 13 and floatably mounted therebetween in a third preferred embodiment of the invention (see FIG. 10).

While the invention herein disclosed has been described by means of specific embodiments, numerous modifications and variations could be made thereto by those skilled in the art without departing from the scope and spirit of the invention set forth in the claims.

What is claimed is:

1. A retractable handle assembly for a luggage case, the handle assembly including a pair of elongate substantially parallel handle units and a handle grip interconnected the handle units, the handle grip having a push button, either handle unit comprising:

a support tube fixed at a bottom of the luggage case;

a sliding tube connected to one end of the handle grip, the sliding tube being slidably disposed in the support tube;

locking means disposed in a lower portion of the sliding tube;

a connecting rod interconnected the push button and the locking means; and damping means floatably disposed between a lower portion of the sliding tube and a bottom of the support tube, wherein the damping means comprises a hollow upright plunger, a spring, a piston rod, a sealing ring biased by the spring thereunder, and a top cap;

wherein the damping means is operative to damply extend upward a predetermined distance in a substantially stable speed by pressing the push button in a pulling operation of the handle assembly.

2. The retractable handle assembly of claim 1, wherein the piston rod comprises a lower neck disposed on the sealing ring, an upright, and a top pipe arm coupled to the locking means.

3. The retractable handle assembly of claim 2, wherein the upright has a section of cross, the cross having a first bar and a second bar shorter than the first bar.

4. The retractable handle assembly of claim 3, wherein the hollow plunger comprises a coupling extended downward from an enclosed lower end, an internal post extended upward from the enclosed lower end with the spring put thereon, two flats at both sides adjacent a top, and a projection on either flat; and the top cap comprises a frame in a shape of "n", a top hole, two opposite dents on an edge of the hole with the first bar fit therein such that the piston rod is operative to slide longitudinally along the dents, and a longitudinal side groove with the projection disposed therein for fastening the spring, the sealing ring, and the piston rod in the plunger.

* * * * *